United States Patent [19]

Ohtaka et al.

[11] Patent Number: 4,667,647

[45] Date of Patent: May 26, 1987

[54] CRANKCASE VENTILATING SYSTEM AND METHOD OF REMOVING OIL MIST FROM GAS IN THE SYSTEM

[75] Inventors: Shoichi Ohtaka; Hideyo Miyano; Yoshio Nuiya; Yukio Kondo, all of Saitama, Japan

[73] Assignee: Honda Giken Kogyo Kabushiki Kaisha, Tokyo, Japan

[21] Appl. No.: 711,556

[22] Filed: Mar. 14, 1985

[30] Foreign Application Priority Data

Mar. 15, 1984 [JP] Japan ..... 59-49894

[51] Int. Cl.[4] ..... F02M 25/06

[52] U.S. Cl. ..... 123/573

[58] Field of Search ..... 123/572, 573, 574, 41.86

[56] References Cited

U.S. PATENT DOCUMENTS

| | | | |
|---|---|---|---|
| 2,742,057 | 4/1956 | Krieck | 123/574 |
| 3,766,898 | 10/1973 | McMullen | 123/574 |
| 3,846,980 | 11/1974 | DePalma | 123/572 |
| 4,103,650 | 8/1978 | Nishida et al. | 123/41.86 |
| 4,502,424 | 3/1985 | Katoh et al. | 123/572 |
| 4,517,951 | 5/1985 | Otaka et al. | 123/572 |

*Primary Examiner*—William A. Cuchlinski, Jr.
*Attorney, Agent, or Firm*—Armstrong, Nikaido, Marmelstein & Kubovcik

[57] ABSTRACT

A crankcase ventilating system removes engine oil particles from a gas containing a blow-by gas and drawn from an engine crankcase, and then introduces the gas into an intake manifold. The crankcase ventilating system includes a first chamber for passing a gas from the crankcase therethrough, a valve for controlling the amount of the gas flowing therethrough, and a second chamber for passing therethrough the gas flowing from the first chamber via the valve and for allowing the gas to flow from the second chamber into the intake manifold. The second chamber is arranged to permit the gas to be expanded therein. The crankcase ventilating system can separate fuel and water from the engine oil.

7 Claims, 4 Drawing Figures

CRANKCASE VENTILATING SYSTEM AND METHOD OF REMOVING OIL MIST FROM GAS IN THE SYSTEM

BACKGROUND OF THE INVENTION

1. Field of the Invention:

The present invention relates to a crankcase ventilating system for an internal combustion engine.

2. Description of the Prior Art:

Many internal combustion engines have a positive crankcase ventilating system (hereinafter referred to as a "PCV system") for drawing a blow-by gas from the crankcase into the intake manifold. The PCV system includes a regulator valve (hereinafter referred to as a "PCV valve") which operates automatically dependent on the difference between pressures in the crankcase and the intake manifold. A mixture of air drawn into the crankcase and the blow-by gas flows through the PCV valve into the intake manifold from which the mixture and an air-fuel mixture are supplied into a combustion chamber. The PCV system is effective to prevent unburned fuel and moisture in the blow-by gas from being accumulated in the crankcase to guard against unwanted damage which would otherwise be caused to engine oil. The PCV system is normally equipped with an oil trap mechanism for separating oil mist particles from the gas flow so that a mist of engine oil which fills the crankcase during engine operation and also the gas in the crankcase will not flow into the intake manifold to prevent the intake manifold from being smeared by the oil and also to avoid undue consumption of the engine oil. The conventional oil trap mechanism has however proven unsatisfactory and has been unable to separate fuel and moisture from the mixture of oil, fuel, and moisture.

SUMMARY OF THE INVENTION

The present invention has been made in an effort to solve the problems with the prior PCV system.

It is an object of the present invention to provide a PCV system capable of effectively separating engine oil from a gas flowing therethrough and also of effectively preventing engine oil from smearing an intake manifold and from being excessively consumed.

Another object of the present invention is to provide a PCV system which will remove unburned fuel and moisture sufficiently from within the crankcase to prevent deterioration of engine oil which would otherwise be caused by such unburned fuel and moisture.

According to the present invention, a crankcase ventilating system comprises a first chamber for passing a gas from a crankcase therethrough, a valve for controlling the amount of the gas flowing therethrough, a second chamber for passing therethrough the gas flowing from the first chamber via the valve and for allowing the gas to flow from the second chamber into an intake manifold, and a means for heating a wall surface of the second chamber. The second chamber is arranged to permit the gas to be expanded therein.

The first and second chambers are separated by a partition on which the valve is mounted. The second chamber is positioned upwardly of the first chamber. The valve has an oil return hole for passing therethrough engine oil from the second chamber into the first chamber.

The above and further objects, details and advantages of the present invention will become apparent from the following detailed description of preferred embodiments thereof, when read in conjunction with the accompanying drawings.

DESCRIPTION OF THE PREFERRED EMBODIMENTS

Figure 1:
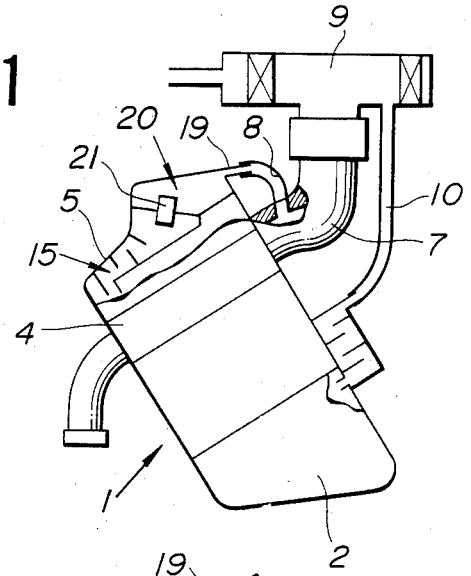
FIG. 1 is a diagrammatic view, partly in cross section, of an engine having a crankcase ventilating system according to an embodiment of the present invention.

A PCV system according to an embodiment of the present invention and its relationship to elements of an engine will be described with reference to FIG. 1.

An engine 1 has a crankcase 2 and an inclined cylinder block mounted on the crankcase 2. The cylinder block has a cylinder head 4 having a valve mechanism chamber S (FIG. 2) closed by a head cover 5 attached to the cylinder head 4. The valve mechanism chamber S communicates through passages 6 (FIG. 2) with a space over a pool of oil in the crankcase 2. The head cover 5 defines therein a first chamber 15 and a second chamber 20 which are principal elements of the PCV system. The engine 1 also has an intake system composed of an intake manifold 7 and an air cleaner 9. The second chamber 20 communicates with the intake manifold 7 through a hose 8, and the space in the crankcase 2 communicates with the space in the air cleaner 9 through a pipe 10.

The details of the PCV system shown in FIG. 1 will be described with reference to FIG. 2. The head cover 5 has a first cavity 11 opening inwardly and a second cavity 16 opening outwardly, the first and second cavities 11, 16 being defined in a top 5*a* of the head cover 5. Since the engine cylinder block is inclined, the top 5*a* of the head cover 5 is directed obliquely upwardly, with the second cavity 16 positioned upwardly of the first cavity 11. The first and second cavities 11, 16 are separated from each other by a partition 17 lying substantially horizontally. The first cavity 11 has a plurality of staggering baffle plates 12 projecting therein. A cover plate 13 is fastened to the head cover 5 in closing relation to the opening of the cavity 11, thus defining the first chamber 15. The cover plate 13 has a gas inlet hole 14 defined in its lower portion. A cap 18 is fastened to the head cover 5 in closing relation to the opening of the second cavity 16, thus defining the second chamber 20. The cap 18 has a gas outlet tube 19 on its upper portion. The partition 17 supports a PCV valve 21 extending therethrough for controlling the amount of a gas flowing therethrough. The PCV valve 21 therefore has a lower end projecting into the first chamber 15 and an upper end projecting into the second chamber 20.

Figure 3:
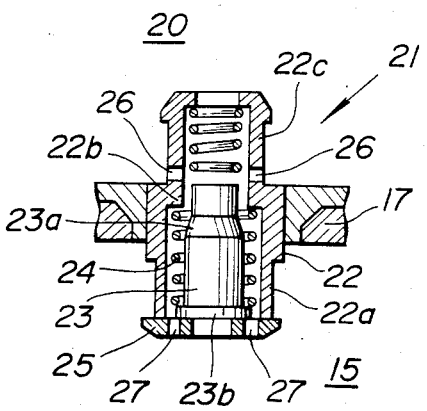
FIG. 3 is an enlarged longitudinal cross-sectional view of a PCV valve in the crankcase ventilating system of FIG. 2.

The PCV valve 21 will be described in detail with reference to FIG. 3. The PCV valve 21 is chiefly composed of a valve body 22, a valve piston 23, and a spring 24. The valve body 22 comprises a main cylindrical portion 22*a* in which the valve piston 23 is movably disposed, a shoulder 22*b* disposed on an upper end of the main cylindrical portion 22*a* and on which an upper end of the spring 24 is seated, and a cylindrical neck portion 22*c* extending upwardly from the shoulder 22*b* and has an inner surface cooperating with the valve piston 23 in defining a throttling orifice. The valve piston 23 has on its upper portion a conical surface 23*a* tapered upwardly and also has on its lower end a flange 23*b* projecting radially outwardly. The flange 23*b* has an upper surface on which a lower end of the spring 24 is seated. The valve piston 23 is normally urged downwardly by the spring 24. A ring 25 is attached to the lower end of the valve body 22 for engaging the lower surface of the flange 23*b* when the valve piston 23 is in a lower-limit position. The valve piston 23 is vertically movable in the valve body 22 under the suction due to a vacuum developed in the intake manifold 7 (FIG. 7). Under a lower pressure in the intake manifold 7, the valve piston 23 is moved toward a higher position to reduce the effective cross-sectional area of the throttling orifice between the inner surface of the cylindrical neck portion 22*c* of the valve body 22 and the conical surface 23*a* of the valve piston 23. Consequently, as the pressure below a predetermined pressure level in the intake manifold 7 becomes lower, the amount of the gas flowing through the PCV valve 21 becomes smaller, keeping substantially constant the ratio of the amount of a blow-by gas generated to the amount of the gas flowing through the PCV valve 21. The cylindrical neck portion 22*c* of the valve body 22 has radial oil return holes 26 with their radially outward ends opening just above the surface of the partition 7 which faces the second chamber 20. The ring 25 attached to the lower end of the valve body 22 also has axial oil return holes 27 which is not closed by the valve piston 23 but provides communication between the interior of the valve body 22 and the first chamber 15 at all times.

Operation of the PCV system will be described. While the engine 1 is in operation, air is introduced through the air cleaner 9 and the pipe 10 into the crankcase 2, and a blow-by gas flows from the combustion chamber through the clearance between the piston and the cylinder wall into the crankcase 2. The gas present in the crankcase 2 is a mixture of the air, the blow-by gas, and a mist of engine oil particles. The blow-by gas contains gasified unburned fuel and moisture which are primarily responsible for damaging the engine oil. The gas in the crankcase 2 then flows through the passages 6 in the cylinder wall into the valve mechanism chamber S in the cylinder head 4, from which the gas flows through the gas inlet hole 14 into the first chamber 11. While flowing through the first chamber 1, the gas is caused by the baffle plates 12 to change its direction of flow quickly and repeatedly, during which time engine oil particles of relatively large size impinge on and are caught by the baffle plates 12 and the wall surface of the first chamber 15. Therefore, these trapped engine oil particles are removed from the gas. The trapped oil will flow down back into the crankcase 2. Engine oil particles of minute size are carried by the gas through the PCV valve 21 into the second chamber 20. Since the gas flows from the first chamber 15 through the small throttling orifice of the PCV valve 21 into the second chamber 20. The pressure in the second chamber 20 is much lower than the pressure in the first chamber 15, so that the gas as it passes through the second chamber 20 is expanded. Stated otherwise, the second chamber 20 serves as an expansion chamber for expanding the gas therein. Since the second chamber 20 is disposed in the head cover 3 which is subjected to a relatively high temperature during operation of the engine, the wall of the second chamber 20 is also kept at a relatively high temperature. The heated wall of the second chamber 20 then heats the particles composed of oil, fuel, and water which are attached thereto. The oil, fuel, and water have different rates of volatility, and only the fuel and water are mainly evaporated, thus separating the oil therefrom. The separated oil flows down into the PCV valve 21 positioned at the bottom of the second chamber 20, then through the oil return holes 26 in the cylindrical neck portion 22*c* of the valve body 22 and the oil return holes 27 in the ring 25, and into the first chamber 15. The oil then passes through the inlet hole 14 back into the valve mechanism chamber S, from which the oil will return into the crankcase 2.

Figure 4:
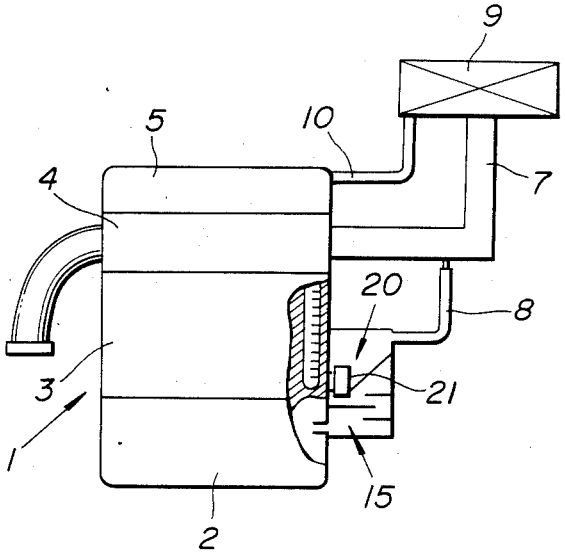
FIG. 4 is a diagrammatic view, partly in cross section, of an engine with a modified crankcase ventilating system according to the present invention.

FIG. 4 illustrates a modified PCV system incorporated in an engine having a vertical cylinder block. Identical or corresponding parts in FIG. 4 are denoted by identical or corresponding reference characters in FIG. 1. The modified PCV system has a PCV valve 21 which is structurally the same as the PCV valve shown in FIG. 3. The modified PCV system also has a first chamber 15 and a second chamber 20 that are structurally different those in the PCV system of FIG. 1. However, since the first and second chambers 15, 20 shown in FIG. 4 can easily be understood from FIG. 4 and the foregoing description of FIGS. 1 and 2, they will not be described in detail. The PCV system of FIG. 4 differs mainly from the PCV system of FIG. 1 in that a pipe 20 for introducing air into a crankcase 2 is coupled to a cylinder head 4, the first chamber 15 is disposed on a side of the crankcase 2, and the second chamber 20 is disposed on a side of a cylinder block 3, so that the second chamber 20 is heated by the heat given off from the cylinder block 3. This arrangement of FIG. 4 is of the same advantages as those of the arrangement shown in FIG. 1.

Figure 2:
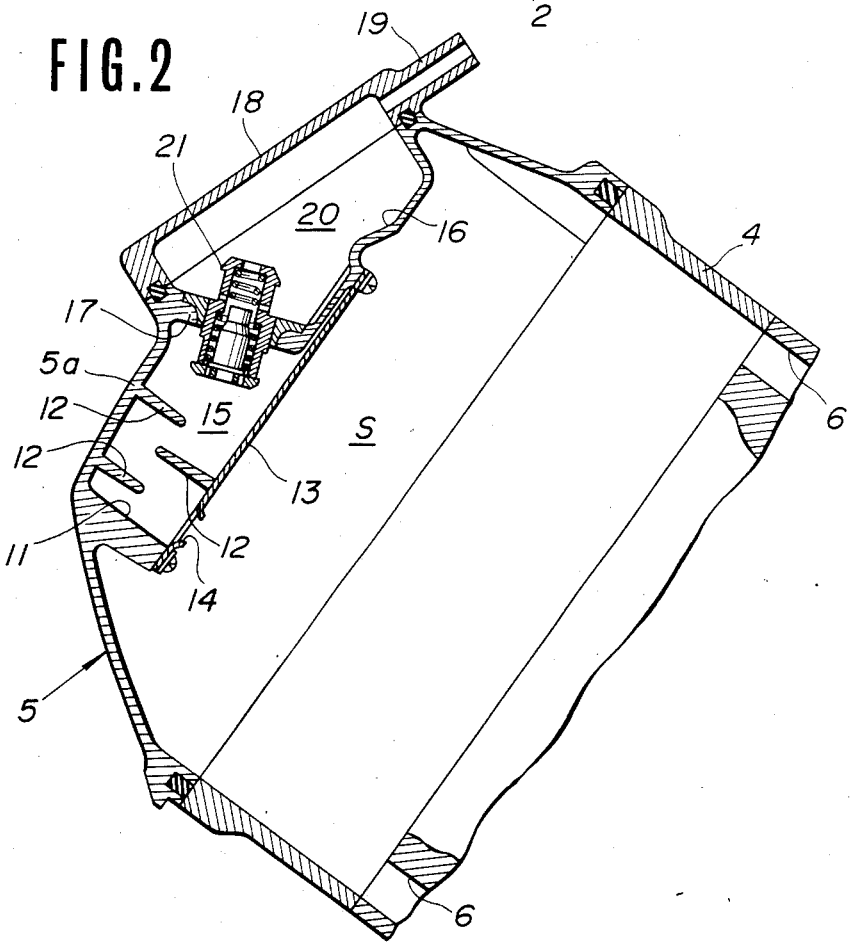
FIG. 2 is an enlarged vertical cross-sectional view of the crankcase ventilating system shown in FIG. 1.

Inasmuch as the second chamber 20 is located upwardly of the first chamber 15 in each of the PCV systems of FIGS. 1 and 4, the separated oil flows by gravity back into the crankcase 2. Therefore, each PCV system is compact in construction. The PCV valve 21 is mounted on the bottom of the second chamber 20 to allow the separated oil to flow down through the oil return valves in the PCV valve 21. Therefore, the PCV valve 21 is cleaned by the oil flowing down therethrough to prevent oil varnish from being deposited on the PCV valve 21, which will operate reliably.

Instead of employing the structure in which the wall of the second chamber is heated by means of the heat from the engine cylinder block, the wall of the second chamber may be heated by hot water in an engine-cooling water jacket, an exhaust gas, or an electric heater, for example. The first and second chambers may be spaced from each other.

In the embodiments of the present invention, the first chamber serves as a trapping chamber for trapping oil mist particles of relatively large size. Therefore, where the proportion of the relatively large oil particles that can be trapped by the trapping chamber with respect to the entire oil mist particles is small, the first chamber may be dispensed with. In case the above proportion is relatively large, the first chamber is preferably provided to extract the relatively large oil mist particles from the gas before the gas is expanded.

Although there have been described what are at present considered to be the preferred embodiments of the present invention, it will be understood that the invention may be embodied in other specific forms without departing from the spirit or essential characteristics thereof. The present embodiments are therefore to be considered in all aspects as illustrative, and not restrictive. The scope of the invention is indicated by the appended claims rather than by the foregoing description.

What is claimed is:

1. A crankcase ventilating system in an internal combustion engine having a crankcase and cylinder block, a cylinder head, a cylinder head cover and an intake manifold, said crankcase ventilating system comprising:

(a) a first chamber for passing a gas from the crankcase therethough;

(b) a valve for controlling the amount of the gas flowing from said first chamber therethrough;

(c) a second chamber defined in said cylinder head cover for passing therethrough the gas flowing from said first chamber via said valve and for allowing the gas to flow from said second chamber into the intake manifold, said second chamber having an effective size greater than that of the valve sufficient to cause expansion of said gas upon entry into said second chamber; and (d) means for heating a wall surface of said second chamber.

2. A crankcase ventilating system according to claim 1, wherein said first chamber is defined in said cylinder head cover and separated from said second chamber by a partition, said valve is mounted on said partition.

3. A crankcase ventilating system according to claim 2, wherein said first chamber comprising a trapping chamber having baffle plates, said second chamber being positioned upwardly of said first chamber, said valve having oil return holes for passing oil therethrough from said second chamber into said first chamber.

4. A method of removing an oil mist from a gas in a crankcase ventilating system which introduces the gas composed essentially of air, a blow-by gas, and the oil mist from a crankcase into an intake manifold, said method comprising the steps of:

(a) drawing said gas from said crankcase into a trapping chamber to remove oil mist particles of relatively large size from said gas in said trapping chamber; and (b) then expanding said gas through a pressure-limiting orifice into a heat exchanger chamber in contact with said engine and heating said gas by conduction and radiation from said engine whereby oil mist is condensed while the more volatile components of the gas remain in the gas phase and are drawn off.

5. A crankcase ventilating system in an internal combustion engine having a crankcase and cylinder block and an intake manifold, said crankcase ventilating system comprising:

(a) a first chamber for passing a gas from the crankcase therethrough;

(b) a valve for controlling the amount of the gas flowing from said first chamber therethrough;

(c) a second chamber for passing therethrough the gas flowing from said first chamber via said valve and for allowing the gas to flow from said second chamber into the intake manifold, said second chamber having an effective size greater than that of the valve sufficient to cause expansion of said gas upon entry into said second chamber and being disposed adjacent to and heated by a side of said crankcase and cylinder block.

6. A crankcase ventilating system according to claim 5, wherein said first chamber is disposed on a side of said crankcase and separated from said second chamber by a partition, and said valve is mounted on said partition.

7. A crankcase ventilating system according to claim 6, wherein said first chamber comprises a trapping chamber having baffle plates, said second chamber being position upwardly of said first chamber, and said valve having oil return holes which remain open under all operating conditions for passing oil therethrough from said second chamber into said first chamber.

* * * * *